US005231925A

United States Patent [19]

Roberts et al.

[11] Patent Number: 5,231,925

[45] Date of Patent: Aug. 3, 1993

[54] METHOD OF MAKING A DECORATED, SUBSTANTIALLY PLANAR SHEET OF GLASS OR POLYMERIC MATERIAL

[76] Inventors: Frank W. Roberts, 6281 Granada Way; W. Calvin Roberts, 6212 Rodeo La., both of Salt Lake City, Utah 84121; Krisjon G. Roberts, 4930 S. 1250 West, Salt Lake City, Utah 84123; Kyler G. Roberts, 6281 Granada Way, Salt Lake City, Utah 84121; Richard A. Roberts, 1712 S. 50 East, Orem, Utah 84058

[21] Appl. No.: 723,575

[22] Filed: Jul. 1, 1991

[51] Int. Cl.[5] ..... B41F 17/26

[52] U.S. Cl. ..... 101/36; 101/142; 101/483; 101/217; 101/490; 40/310

[58] Field of Search ..... 101/36, 37, 217, 327, 101/328, 424.2, 490, 492, 493, DIG. 30, 142, 143, 483; 40/310

[56] References Cited

U.S. PATENT DOCUMENTS

| | | | |
|---|---|---|---|
| 105,300 | 7/1870 | Bowdoin | 101/493 X |
| 770,486 | 9/1904 | White | 101/142 |
| 1,031,288 | 7/1912 | Pearce | 101/142 |
| 1,976,714 | 10/1934 | Chisolm | 101/142 |
| 2,158,633 | 5/1939 | Normandi | 427/266 |
| 2,893,320 | 7/1959 | Jones | 101/493 |
| 4,115,939 | 9/1978 | Marks | 40/310 |
| 4,273,816 | 6/1981 | Tollette | 40/310 |
| 4,395,946 | 8/1983 | Price | 101/152 |
| 4,960,054 | 10/1990 | Pfau | 101/451 |

FOREIGN PATENT DOCUMENTS

| | | | |
|---|---|---|---|
| 2119758 | 11/1972 | Fed. Rep. of Germany | 101/217 |
| 56-291 | 4/1982 | Japan | 101/36 |
| 144351 | 7/1986 | Japan | 101/217 |
| 2123346 | 2/1984 | United Kingdom | 101/492 |

*Primary Examiner*—Edgar S. Burr
*Assistant Examiner*—Eric P. Raciti
*Attorney, Agent, or Firm*—Terry M. Crellin

[57] ABSTRACT

A process is disclosed for making a decorative, essentially planar sheet of material having a design applied to one side, with the design being viewed through the sheet from the opposite side. A foreground component of the design is produced on a first resilient roller, and the first roller is rotated about its cylindrical axis. A second resilient roller rotates adjacent to the first resilient roller to form a nip with the first cylindrical roller. The planar sheet is fed through the nip formed between the first and second resilient rollers so that the foreground component of the design on the first resilient roller is transferred to the opposite side of the planar sheet. A background component of the design is produced on a third resilient roller, and the third roller is rotated about its cylindrical axis. A fourth resilient roller rotates adjacent to the third roller to form a nip with the third roller. The planar sheet to which the foreground component of the design has been previously applied is fed through the nip formed between the third and fourth resilient rollers so that the background component of the design on the third resilient roller is transferred to the opposite side of the planar sheet superposed over the foreground component that was applied previously.

6 Claims, 1 Drawing Sheet

METHOD OF MAKING A DECORATED, SUBSTANTIALLY PLANAR SHEET OF GLASS OR POLYMERIC MATERIAL

BACKGROUND OF THE INVENTION

1. Field of the Invention

The present invention relates generally to a method for making a decorative, substantially planar sheet made of glass or a polymeric material. In particular, the invention relates to a process for applying designs on one of the broad, flat sides of a substantially rigid, planar sheet of material, with the design being viewed through the sheet from the other side of the sheet. The sheets can be advantageously be used as decorative panels, either interior or exterior, or the sheets can be formed into other shapes such as counter tops, tube and shower surrounds, cabinet doors, and cabinet drawer facings, for example. In a particularly preferred form, the sheet has a surface appearance which is virtually indistinguishable from polished natural materials such as wood and marble.

2. State of the Art

Decorative sheets and panels made of polymeric material for use as wall panels, counter tops, table tops, cabinet facings, tub and shower surrounds, etc., are well known in the art. Various methods have been used to provide numerous designs on the surface of such sheets and panels. Heretofore, however, it has been virtually impossible to produce a design, especially one that does not have a pattern repeat, on large, planar, rigid sheets made of glass or synthetic, polymeric materials.

Cast acrylic material has been formed into sheets and panels as well as other shapes. Such cast acrylic items can be made to quite closely resemble polished marble and other polished mineral materials, but the articles made of cast acrylic are generally expensive and are not true to duplication. It would be highly desirable to provide a relatively inexpensive sheet made of glass or polymeric material which resembles very closely the feel and look of polished marble and other polished mineral materials. It is further desirable to provide a large planar sheet of glass or polymeric material on which a design has been faithfully transferred wherein the decorated sheet resembles any of various surfaces.

The present inventors have previously discovered that sheets of glass or acrylic material which are semi-opaque, especially those having a milky white appearance, can be made to close resemble polished marble or other polished mineral materials. The sheet of acrylic material first had a powdered pigment applied to the underside of the sheet. A coating of contact cement such as rubber cement was then applied to the surface of the sheet of material containing the powdered pigment, and a protective layer was firmly adhered to the exposed surface of the rubber cement.

Although it was possible to make the acrylic sheets closely resemble polished marble, it was found that the person applying the powdered pigment had to be extremely skilled. In addition, even when the powdered pigment was applied by a skilled artist, it was possible to achieve any degree of uniformity from one sheet of material to the next. There must be a mineral degree of uniformity from sheet to sheet to make the sheets resemble polished marble or other mineral material mined from a particular quarry. Because the method was labor intensive and therefore expensive, and because of the lack of being able to achieve any degree of uniformity from one sheet of material to the next, the method and the products, although being aesthetically acclaimed, are not completely successful commercially.

3. Objectives

A particular objective of the invention is to provide an improved, novel, inexpensive method of making large, essentially planar sheets of glass or polymeric material that have surfaces that resemble very closely various items such as polished wood, polished marble or other polished mineral materials, wherein it is possible to achieve the desired degree of uniformity from one sheet of material to the next, and further wherein a large sheet having a dimensions of at least three feet wide by 8 feet long can be produced without repeated patterns appearing in the designs formed on the surface of the sheet.

Another objective of the present invention is to provide a novel process for reverse printing a design on large, rigid, planar sheets of glass or plastic material, wherein the design is separated into at least two components including a background component, a foreground component and any intermediate components, with the foreground being printed first and then subsequently printing the intermediate components, if any, and finally printing the background component so that the design is viewed through the sheet from the side opposite that to which the design is printed.

BRIEF DESCRIPTION OF THE INVENTION

The decorative sheets of rigid, planar material are produced in accordance with the present invention by an improved process in which a design is produced on a large cylindrical roller having a diameter of at lease about 30 inches. The large cylindrical roller is rotated about it cylindrical axis, and a smaller, resilient print roller is rotated in contact with the surface of the large cylindrical roller. The surface of the resilient print roller moves at the same linear surface speed as the linear surface speed of the large cylindrical roller. A nip is formed at the contact of the large cylindrical roller and the resilient print roller, and the design on the large cylindrical roller is transferred from the surface of the large cylindrical roller to the surface of the smaller, resilient roller.

A second resilient roller is rotated so that the surface of the second resilient roller moves at the same linear speed as the linear speed of the print roller. A nip is formed between the print roller and the second resilient roller. The sheets to be decorated are fed successively through the nip formed between the print roller and the second resilient roller. One of the surfaces of each sheet contacts the surface of the print roller. At the point of contact, the surface of the sheet moves with the same linear speed as the surface of the print roller, and the design on the print roller is transferred to the surface of the sheet.

In a particularly preferred embodiment of the invention, the sheet of glass or polymeric material is semi-opaque with a milky white appearance or being tinted with a background color of the design which is to be formed thereon. The design is made to look like the veins and mottled appearance of polished, natural marble. The design when applied to the underside of the semi-opaque sheet can be sufficiently seen through the semi-opaque sheet to give the sheet of material a virtually identical appearance to polished, natural marble. The veining and mottling created by the design on the under side of the sheet appear to extend into the depth of the sheet of material just at the veining and mottling extend into the depth of polished, natural marble.

Additional objects and features of the invention will become apparent from the following detailed description, taken together with the accompanying drawings.

THE DRAWING

A schematic representation of the apparatus that can be used in performing the process of the present invention is illustrated in the single FIGURE shown in the accompanying drawing.

DETAILED DESCRIPTION OF THE INVENTION

Figure 1:
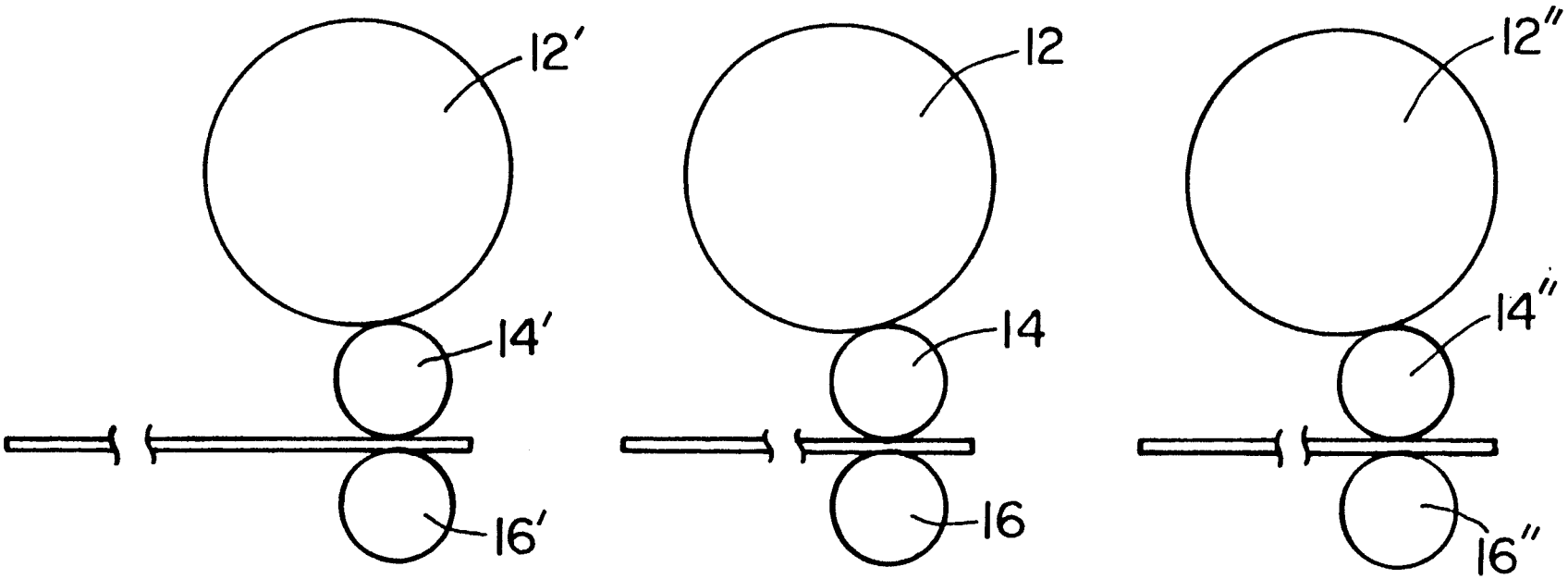

A novel process is provided for making decorative sheets of substantially planar, rigid material such as glass or polymeric material which are highly useful as decorative, custom wall panels (either interior or exterior) and for forming into various other items such as counter tops, table tops, tub and shower surrounds, cabinet tops, cabinet sides, cabinet facings, cabinet doors, cabinet drawer facings, shelves, free standing partitions, and passage way doors. The process will be described with reference to the single figure of the drawings which shows an schematical elevation of the major components of apparatus used in performing the process.

A design is produced on a large cylindrical roller 12 having a diameter of at least about 30 inches. The large diameter of the cylindrical roller 12 allows designs of 8 feet or more to be produced without a repeat pattern in the design. The cylindrical length of the roller 12 is at least about 3 feet and preferably 4 or 5 feet.

The cylindrical roller 12 is rotated about its cylindrical axis, and a smaller, transfer roller 14 is rotated in counter rotation in contact with the larger cylindrical roller 12. The surface of the transfer roller 14 moves at the same linear speed as the linear speed of the surface of the larger roller 12. A nip is formed between the larger cylindrical roller 12 and the transfer roller 14, with the design being transferred to the transfer roller 14 at the nip.

A second roller 16 is mounted closely adjacent to the transfer roller 14. The second roller 16 is rotated in counter rotation to the transfer roller 14, with the surface of the second roller having the same linear speed as the linear speed of the transfer roller 14. A nip is formed between the second roller 16 and the transfer roller 14, with the second roller 16 being spaced from the transfer roller 14 by a distance such that the sheet of planar, rigid material can be fed through the nip between the second roller 16 and the transfer roller 14.

The sheets receive the design from the transfer roller 14 as the sheets are fed successively through the nip between the second roller 16 and the transfer roller 14. The design is transferred when one of the surfaces of the sheets contact the surface of the transfer roller 14. At the point of contact between the sheets and the transfer roller 14, the surface of the sheet moves with the same linear speed as the speed of the surface of the transfer roller 14.

The design can be of any desirable artistic or other graphic material including pictures, drawings, geometric shapes, abstract expressions, and representations of natural materials such as wood grains, polished marble and other polished mineral materials. In particularly preferred embodiments, the design is either that of a mottled surface containing veins, so as to closely resemble the surface of polished marble or other polished mineral material or of a grained surface identical to polished wood.

The sheets can be made of glass or of virtually any polymeric material. A preferred polymeric material is acrylic. In one preferred embodiment, the sheet can be optically transparent. In another embodiment, the sheet is at most only semi-opaque when the sheet has a depth of up to about ¼ inch. By semi-opaque is meant that light will pass through the sheet but will be dispersed such as to produce a blurred or fuzzy image as contrasted to a distinct, sharp image as achieved with a transparent sheet of material.

The transfer roller 14 and the second roller 16 are both smaller than the larger cylindrical roller 12, with the transfer roller 14 and the second roller 16 generally having a diameter that is no greater than one-half the diameter of the larger cylindrical roller 12. Both the transfer roller 14 and the second roller 16 are formed from a resilient material or have a surface formed from a resilient material. The resilient material can be rubber or an elastomeric compound or any material resembling rubber or elastomeric compounds. The resilient rollers, or the resilient surfaces of the rollers, allow the rigid, glass or polymeric sheets to pass through the nip formed between the rollers without breakage or damage to the sheets.

Preferably, the sheets are made of an acrylic polymer or a similar polymer such as polyester or vinyl. As mentioned previously, the sheets can also be made of glass. The thickness of the sheets of glass or polymeric material is preferably between about 0.05 and 0.75 inch. The inks, dyes and coloring agents, including powdered coloring agents, can be any of those used in the printing art. Inasmuch as the sheets of material being made are often used in vacuum forming operations following the printing procedure of the present invention, it is advantageous to use inks, dyes and coloring agents that are compatible with the temperatures used in the subsequent vacuum forming operations.

In one particularly preferred embodiment of the invention, a series of apparatus, each comprising a large cylindrical roller 12, 12', 12'' and the associated transfer roller 14, 14', 14'' and second roller 16, 16', 16''. As shown schematically in the drawing, a series of three such apparatus is used. The design that is to be transferred to the sheets are separated into at least two component including a background component, a foreground component and intermediate components, if any. With the three tiered apparatus shown schematically in the drawing the design would, of course, be separated into a background component, one intermediate component and a foreground component.

The sheets to be decorated move successively through the three parts of the apparatus from left to right as shown in the drawing. The foreground component of the design is formed as a master on the large cylindrical roller 12 of the first tier of apparatus, and the foreground component is transferred to the successive sheets as they pass through the nip of the transfer roller 14 and second roller 16 of the first tier of apparatus.

The intermediate component of the design is formed as a master on the large cylindrical roller 12 of the second tier of apparatus. The intermediate component of the design is transferred to each sheet as the sheets pass through the nip of the transfer roller 14 and the second roller 16 of the second tier of apparatus.

The background component of the design is formed as a master on the large cylindrical roller 12 of the third tier of apparatus. The background component of the design is transferred to each sheet at the sheets pass through the nip of the transfer roller 14 and the second roller 16 of the third tier of apparatus.

The design made by reverse printing of the separate components on one side of the sheet is viewed from the other side of the sheet. The design, when so viewed, has been unexpectedly found to have a high degree of observed depth, even through the printing of the design on the sheet is only two dimensional.

It has been found advantageous to clean the surface of the transfer roller 14 of any residue as the roller 14 travels between the nip formed with the second roller 16 and the nip formed with the large cylindrical roller 12. Means for cleaning the surface of the roller 14 are well known in the printing art and will not be further described herein.

Although preferred embodiments of the process of decorating rigid, planar sheets of glass or polymeric material have been illustrated and described, it is to be understood that the present disclosure is made by way of example and that various other embodiments are possible without departing from the subject matter coming within the scope of the following claims, which subject matter is regarded as the invention.

We claim:

1. A process for making a decorative sheet useful as a decorative wall panel, counter top or the like, comprising the steps of:

providing an essentially planar sheet of substantially transparent glass or rigid polymeric material, applying a design to a first side of said planar sheet, viewing said design from a second side of said planar sheet so as to view said design through the planar sheet, and perceiving said design to be virtually indistinguishable from polished natural materials from the group consisting of wood, marble and other mineral materials, said step of applying a design further comprising the steps of:

producing a foreground component of the design on a surface of a first resilient roller;

rotating the first cylindrical roller about its cylindrical axis;

rotating a second resilient roller about its cylindrical axis so that a surface of the second resilient roller moves at the same relative inner speed as the linear speed of the surface of said first resilient roller and forms a nip with the surface of said first resilient roller;

feeding said planar sheet through the nip formed between the surfaces of said first and second resilient rollers so that said opposite side of said planar sheet contacts the surface of said first resilient roller, and at the point of contact, said opposite side of said planar sheet moves with the same relative linear velocity as the surface of said first resilient roller, whereby the foreground component of said design on said first resilient roller is transferred to said opposite side of said planar sheet producing a background component of the design on a surface of a third resilient roller;

rotating the third cylindrical roller about its cylindrical axis;

rotating a fourth resilient roller about its cylindrical axis so that a surface of the fourth resilient roller moves at the same relative linear speed at the linear speed of the surface of said third resilient roller and forms a nip with the surface of said third resilient roller; and feeding said planar sheet that has previously passed through the nip formed between said first and second resilient rollers through the nip formed between the surfaces of said third and fourth resilient rollers so that said opposite side of said planar sheet contacts the surface of said third resilient roller, and at the point of contact, said opposite side of said planar sheet moves with the same relative linear velocity as the surface of said third resilient roller, whereby the background component of said design on said third resilient roller is transferred to said opposite side of said planar sheet.

2. A process in accordance with claim 1 wherein the sheet is transparent.

3. A process in accordance with claim 2, wherein the sheet is formed from polymeric material.

4. A process in accordance with claim 1, wherein the sheet is semi-opaque.

5. A process in accordance with claim 4, wherein the sheet is formed from polymeric material.

6. A decorative sheet which is made by the process of claim 1.

* * * * *